US006026754A

United States Patent [19]

Kohlhaas

[11] Patent Number: 6,026,754

[45] Date of Patent: Feb. 22, 2000

[54] LOW VIBRATION, HIGH STRENGTH PALLET

[76] Inventor: Frank Anthony Kohlhaas, 8 Little Bay Harbor Dr., Ponte Vedra Beach, Fla. 32082

[21] Appl. No.: 09/377,014

[22] Filed: Aug. 19, 1999

[51] Int. Cl.[7] ..... B65D 19/12

[52] U.S. Cl. ..... 108/56.3; 108/51.3

[58] Field of Search ..... 108/56.3, 57.12, 108/56.1, 51.11, 51.3

[56] References Cited

U.S. PATENT DOCUMENTS

| | | | |
|---|---|---|---|
| 3,598,065 | 8/1971 | Young . | |
| 3,610,172 | 10/1971 | Wharton . | |
| 3,664,272 | 5/1972 | Sanders | 108/56.3 X |
| 3,804,032 | 4/1974 | Baucom . | |
| 3,915,099 | 10/1975 | Wies et al. . | |
| 4,119,205 | 10/1978 | Delany | 108/56.3 X |
| 4,425,852 | 1/1984 | Riviere . | |
| 4,604,014 | 8/1986 | Frano . | |
| 5,367,961 | 11/1994 | Arai et al. . | |
| 5,513,577 | 5/1996 | Weis . | |
| 5,799,586 | 9/1998 | Casanovas et al. | 108/56.3 |

FOREIGN PATENT DOCUMENTS

| | | |
|---|---|---|
| 2108923 | 5/1983 | United Kingdom . |

*Primary Examiner*—Jose V. Chen
*Attorney, Agent, or Firm*—Thomas C. Saitta

[57] ABSTRACT

A nestable, single deck member pallet having a pair of sheet members separated by a perimeter frame member and multiple ring support members positioned in apertures cut into the deck member, hollow leg members connected to the ring members, and vibration damping material substantially filing the interior space of the deck member.

19 Claims, 2 Drawing Sheets

LOW VIBRATION, HIGH STRENGTH PALLET

BACKGROUND OF THE INVENTION

This invention relates generally to the field of pallets used to support loads, the pallets being designed to be movable by insertion of fork lift tines into or beneath the deck member, and more particularly the invention relates to single deck pallets with depending legs, where the pallets can be rack-supported under opposing edges or placed directly on the floor, and where the empty pallets are nestable when vertically stacked, such that the legs of a superior pallet are received within the open tops of the legs of a inferior pallet such that the overall height of the stacked pallets is minimized.

Nestable, single deck member pallets which can be rack-supported or placed directly on the floor are well known in the industry, and many different constructions and designs are in use or have been contemplated. Because the pallets have only a single deck member supported by a plurality of legs, much effort has gone into creating pallet designs with increased compressive strength, rigidity and durability, an effort which often contrasts with the need to minimize costs of construction and repair. Both the design of the deck member and the design of the legs have improved, but the improved strength, rigidity and durability properties have often resulted in pallets which excessively transmit shocks and vibrations produced during transport and movement, such as from fork lift handling and residence time on trucks, planes, trains or ships, directly into the load being supported on the pallet. This is a major problem for sensitive loads, such as electronic equipment or appliances, where significant damage is often encountered during transport and storage while the goods are still encased in their packing boxes.

It is an object of this invention to provide a nestable, single deck member pallet which has very high compressive load characteristics, very good rigidity or resistance to flex and torsional or tensional skewing when rack-supported, is relatively light-weight and low cost in regard to manufacture and repair, is very durable when in use, and which has vibration damping characteristics to minimize transmission of shocks and vibrations through the legs and the deck member. These and other objects will be accomplished by construction of a pallet as set forth below.

SUMMARY OF THE INVENTION

The invention is a nestable, single deck member pallet comprising a deck member supported by a plural number of leg members, the leg members being hollow and open-topped and the deck member being apertured where the legs are joined such that the legs of a superior or upper pallet will fit into the legs of an inferior or lower pallet when the empty pallets are vertically stacked in order to minimize the height of the pallet stack during transport or storage. The pallet is capable of supporting a load by being placed directly on the ground or floor such that the leg members maintain the deck member a minimum distance above the ground or floor to allow access to the tines of a fork lift or hand truck to lift and move the pallet. The pallet is also sufficiently rigid to be capable of supporting a substantial load when rack-supported, where racks are positioned beneath opposing edges of the deck member with no direct support under the interior of the pallet.

The pallet comprises a single deck member formed from two generally planar sheet members which have frame members disposed between them along the perimeter, the perimeter frame members extending only a short distance into the interior space of the deck member. The sheet members are formed of plywood, hardboard, oriented strand board, particle board or the like. The sheet members are apertured to receive ring support members, the ring support members being annular and comprised of an upper collar which mates with the aperture in the upper sheet member, an upper flange which supports the underside of the upper sheet member, a lower flange which abuts the upper side of the lower sheet member, a lower collar which mates with the aperture in the lower sheet member, and means to connect the ring support collar to a leg member, preferably internal threading. The ring support members maintain the upper and lower sheet members in a fixed relation while also providing compressive support to any load. The leg member is hollow and comprises an insertion end having connection means for joining it to the ring support member, preferably external threading, and a support flange which supports the underside of the lower sheet member. Through this construction the leg members can be easily replaced if necessary. The interior of the deck member is preferably substantially filled with a vibration damping material, which may comprise layers of corrugated paperboard, polystyrene or similar polymer foam blocks or particles, expandible reactive polymer foam, or similar materials.

DETAILED DESCRIPTION OF THE INVENTION

With reference to the drawings, the invention will now be described in detail with regard for the best mode and the preferred embodiment. The invention is a high-strength, rigid, low vibration, single deck pallet capable of being supported directly underneath by depending legs placed on an underlying support surface or suspended on opposing edges in a storage rack. The pallet may be moved by forklift, hand truck or the like. For purposes of this disclosure, the term lower is to refer to the direction below the pallet when it is properly oriented for use to support a load on a surface, and the term upper is to refer to the opposite direction.

Figure 2:
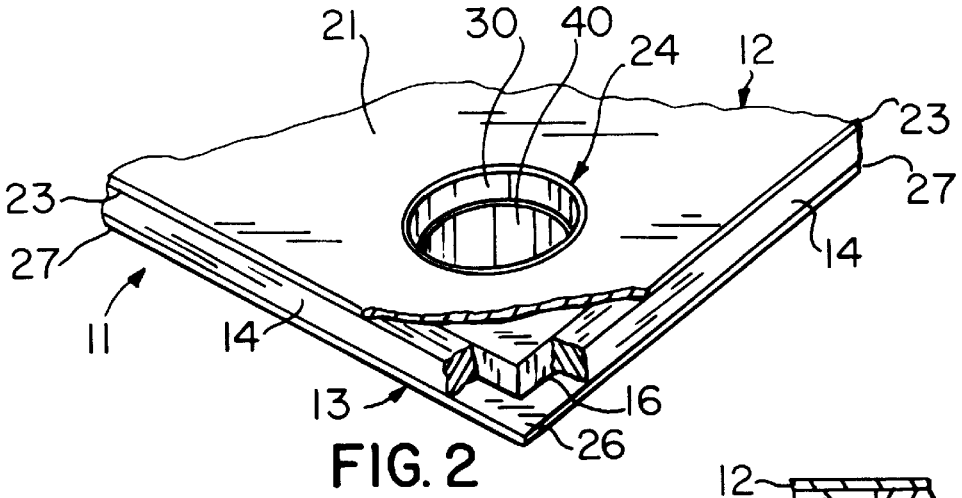
FIG. 2 is a perspective view of a corner of the pallet, with portions of the upper sheet and perimeter frame members removed to expose the vibration damping material in the interior space.
Figure 1:
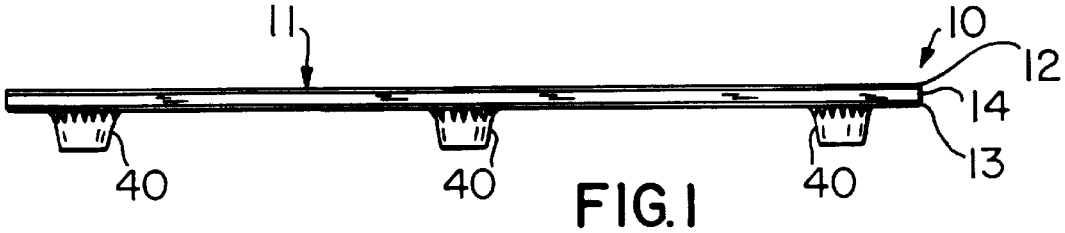
FIG. 1 is a side view of the pallet.
Figure 3:
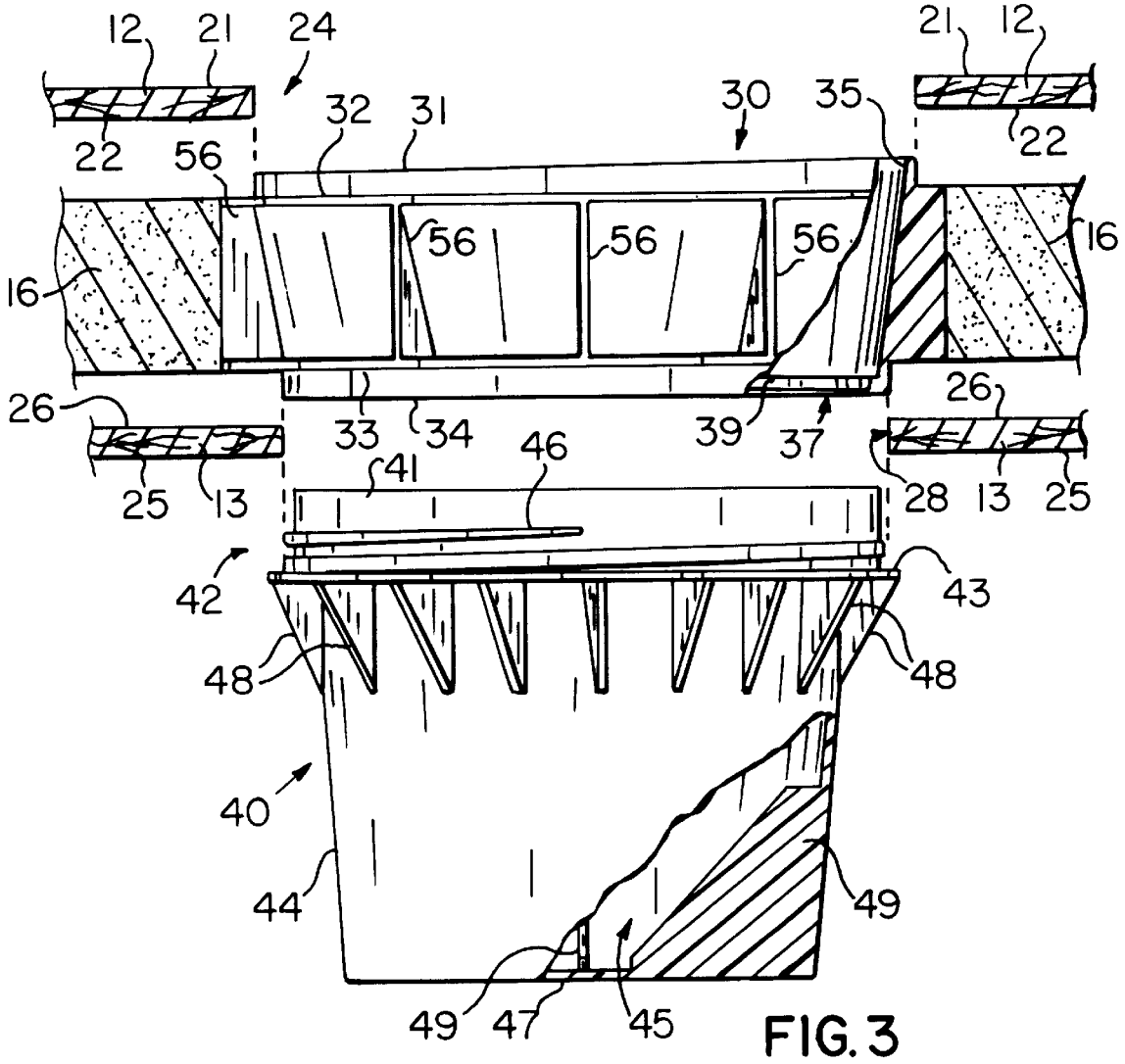
FIG. 3 is an expanded side view of the deck member and a leg member, with portions of the ring member and leg member removed to expose interior features and shown in cross-section.

As seen in FIGS. 1 through 3, the single deck pallet 10 comprises a generally planar deck member 11 having a plural number of spaced support leg members 40. The deck member 11 comprises an upper sheet member 12 and a lower sheet member 13 connected by perimeter frame members 14. The upper sheet member 12 comprises an upper or exterior side 21, a lower or interior side 22, edges 23 defining a perimeter, preferably square or rectangular, and a plural number of ring-receiving apertures 28, preferably circular. The lower sheet member 13 comprises in similar fashion an upper or interior side 26, a lower or exterior side 25, edges 27 defining the preferably square or rectangular perimeter, and a plural number of preferably circular ring-receiving apertures 28 aligned coaxially with the apertures 24 of the upper sheet member 12. Typical dimensions for the upper and lower sheet members 12 and 13 are 40 by 48 inches and one quarter inch in thickness. Upper and lower sheet members 12 and 13 must be formed from a material which is relatively rigid and non-compressible under load, and very non-elastic in the lateral directions, and suitable materials are plywood, hardboard, oriented strand board, particle board or the like.

Figure 5:
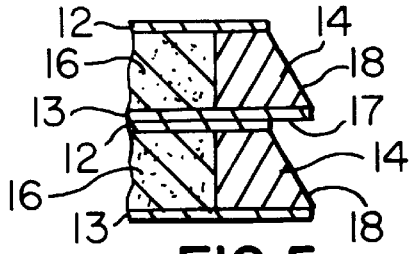
FIG. 5 is a cross-sectional view of two stacked pallets where the perimeter members are formed with a sloped outer wall.

The upper and lower sheet members 12 and 13 are connected together by perimeter frame members 16, which comprise rigid structural members which are positioned between the two sheet members 12 and 13 adjacent the edges 23 and 27. The perimeter frame members 16 are relatively non-flexible in the vertical direction, preferably extend the entire length of the edges 23 and 27, but extend only a short distance inwardly from the edges 23 and 27, such that an interior space 15 is defined by the combination of the upper sheet member 12, the bottom sheet member 13 and the perimeter frame members 16. Each perimeter frame member 16 is preferably composed of solid wood with a square cross-sectional profile, such as an elongated 2 by 2 board, which has actual dimensions of 1.5 inches by 1.5 inches. In an alternative preferred construction, at least one of the perimeter frame members 16 has a cross-sectional profile where the bottom is wider than the top to define a sloped outer wall 18, which in combination with an upper sheet member 12 slightly smaller than the lower sheet member 13 produces a pallet 10 which will have a short segment area of the lower sheet member 13 around the perimeter exposed when multiple pallets 10 are stacked, as shown in FIG. 5, this exposed lifting area 17 providing a means to lift the upper pallet 10 from a lower pallet 10 by sticking the tips of the lift tines under the lifting area 17. The combination of the ¼ inch sheet members 12 and 13 with the perimeter frame member 16 produces a deck member 11 which is 2 inches thick. The upper and lower frame members 12 and 13 may be joined to the perimeter frame members 16 by mechanical fasteners, such as nails or screws, but it is preferred that the components be bonded together using a suitable adhesive.

The deck member 11 is preferably provided with five sets of coaxially aligned apertures 24 and 28, with the upper sheet member apertures 24 preferably being of greater diameter than the lower sheet member apertures 28. One such set of apertures 24 and 28 should be centered at the midpoint of the deck member 11, with the remaining four sets of apertures 24 and 28 distributed evenly toward each corner and relatively near the edges 23 and 27, such that the weight of a load will be spread out and evenly distributed across all leg members 40 and so that the tines of a forklift can be inserted between the leg members 40 and underneath the deck member 11 to move or raise the pallet 10.

A ring support member 30 is positioned within and secured to each of the sets of apertures 24 and 28, preferably by adhesive bonding, as best seen in FIG. 3. The ring support members 30 prevent relative vertical movement between the upper sheet member 12 and the lower sheet member 13, such that the distance between the interior side 22 of the upper sheet member 12 and the interior side 26 of the lower sheet member 13 remains constant. The ring support members 30 also preclude relative torsional movement, shearing movement, horizontal stretching under tension and horizontal compressing under compression between the upper sheet member 12 and the lower sheet member 13. The presence of the ring support members 30 in combination with the perimeter frame members 16 minimizes flexing of the deck member 11 even with heavy compressive loads and in situations where the pallet 10 is supported along its edges, since the two sheet members 12 and 13 are rigidly connected at five interior locations as well as completely around the perimeter. The ring support members 30 also minimize vibrational effects between the upper sheet member 12 and lower sheet member 13. Ring support members 30 are preferably formed of a hard, rigid plastic, such as polystyrene, which is compatible with adhesives also compatible with wood.

The ring support member 30 comprises an upper annular collar 31 which is sized to mate in snug manner with an aperture 24 in the upper sheet member 12, preferably about six inches in diameter, with the height of upper annular collar 31 preferably equal to or less than the thickness of upper sheet member 12. A horizontally disposed upper annular flange 32 extends radially beneath the upper annular collar 31, the diameter of the upper annular flange 32 being greater than the diameter of the upper annular collar and the aperture 24, such that the interior side 22 of the upper sheet member 12 will sit directly on the upper annular flange 32. A lower annular flange 33 is disposed a distance below the upper annular flange 32 and contacts the interior side 26 of lower sheet member 13. A lower annular collar 34 extends beneath the lower annular flange 33, the height of the lower annular collar preferably equal to or less than the thickness of the lower sheet member 13 and the diameter of the lower annular collar 34 corresponding to the diameter of the aperture 28 in the lower sheet member 13, preferably about 5.5 inches in diameter, so that a secure mating is achieved. The diameter of the lower annular flange 33 is greater than the diameter of the lower annular collar 34 and the aperture 28. Most preferably the diameter of the lower annular collar 34 and the lower sheet member aperture 28 is less than the diameter of the upper annular collar 31 and the upper sheet member aperture 24, to provide space to receive the legs 40 of stacked pallets 10 and such that a larger area of contact is present between the lower annular flange 33 and the lower sheet member interior side 26 than there is between the upper annular flange 32 and the upper sheet interior side 22 to provide increased resistance to compressive loads. The ring support member 30 is relatively thin such that the interior wall 35, which is preferably tapered to better receive leg members 40 when multiple pallets are vertically stacked, defines a relatively large open interior 36. Vertically oriented, radially extending flange brace members are preferably provided between upper annular flange 32 and lower annular flange 33. Connection means 37 are provided in ring support member 30 for receiving and joining the ring support member 30 and leg member 40. The connection means 37 preferably comprise internal threading disposed on the lower portion of interior wall 35, which in combination with corresponding external threading 46 on the leg member 40 allows the leg member 40 to be easily yet securely attached to the ring support member 30 in a manner which allows for removal and replacement of the leg member 40 if necessary. Alternatively, other temporary connection means 37 can be utilized, or the leg member 40 may be permanently attached to the ring support member 30.

In a most preferred construction, vibration damping filler material 16 is disposed between the upper sheet member 12 and lower sheet member 13 during fabrication of the deck member 11 to substantially fill the interior space 15. The vibration damping material 16 interrupts and absorbs vibrational waves passing through the deck member 11 and preferably comprises block or structurally integral components rather than a collection of loose particles or bodies, so that the vibration damping material 16 can be bonded to the interior sides 22 and 26 to add structural integrity to the deck member 11 for increased resistance to tensional and compressive forces. Preferable materials for the vibration damping material 16 include layers of corrugated paperboard, each layer being adhered to the adjacent layer, polystyrene blocks properly cut to fill the interior space 15 of the deck member 11, blown-in polymer foam particles or expanded polymer foam injected into the open interior 15 after construction and allowed to cure into a rigid mass.

Leg members 40 are preferably composed of a plastic, and most preferably of a plastic which is less rigid than the plastic used to form the ring support members 30, such as a polyethylene or polypropylene. By utilizing a slightly deformable plastic, the leg members 40 are less susceptible to damage from contact with the tines of a forklift and are less likely to transmit vibrations to the load by absorbing the shock effects, although the plastic must still have sufficient rigidity under load to support the deck member 11. The leg members 40 are preferably hollow and tapered such that a leg member 40 on one pallet 10 may be nested vertically into the ring support member 30 and leg member 40 of another pallet 10. Leg members 40 comprise an annular insertion end member 41 sized to fit within the lower annular collar 34 of the ring support member 30, connection means 37 which allow the leg member 40 to be joined to the ring support member 30, a horizontally disposed annular support flange 43 beneath the insertion end member 41, a main body 44 defining a hollow interior 45, and a bottom 47. The annular support flange 43 abuts the exterior side 25 of the lower sheet member 13, the diameter of the annular support flange 43 being greater than the diameter of the insertion end member 41 and the diameter of the lower sheet member aperture 28, so that the annular support flange 43 supports the deck member 11. Vertically oriented flange brace members 48 are preferably provided on the main body 44 beneath the annular support flange 43 to prevent the annular support flange 43 from shearing under heavy loads. Vertically oriented interior brace members 49 are also preferably provided in the hollow interior 45 to strengthen the main body 44. The connection means 42 may comprise any suitable mechanism for joining the leg member 40 to the ring support member 30, but preferably as shown comprises external threading 46 mounted onto the insertion end member 41, the external threading 46 corresponding to the internal threading 39 of the ring support member 30.

Figure 4:
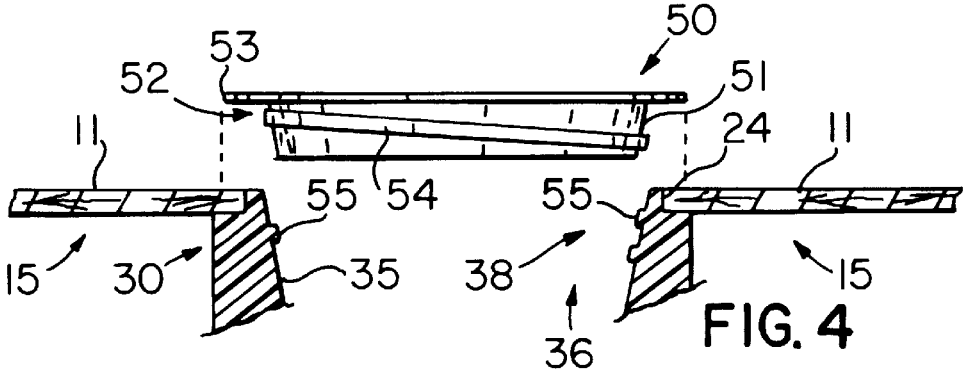
FIG. 4 is an expanded view of a cap member in conjunction with part of a ring member and upper sheet member shown in cross-section.

Optional cap members 50, as shown in FIG. 4, may be utilized in an alternative embodiment to further secure the upper sheet member 12 to the ring support members 30. The cap or lid member 50 is comprised of an annular wall 51 tapered to correspond to the tapering of the interior wall 35 of the ring support member 30 and a radially extending, low profile flange or lip 53 which has a diameter greater than the diameter of the upper sheet member aperture 24. Connection means 52 are provided for joining the cap member 50 to the ring support member 30, and as shown may comprise external threading 54 on the annular wall 51 which corresponds to upper internal threading 55 positioned on the interior wall 35 of the ring support member 30. With the cap member 50 in place, the edges of the upper sheet member 12 are secured between the radially extending flange 53 of the cap member 30 and the upper annular flange 32 of the ring support member 30.

The pallets as described are strong, durable and rigid, whether supported from the edges or with the legs 40 placed on the ground. A construction with plywood upper and lower sheet members 12 and 13 and corrugated paperboard as the vibration damping material 16 was proven under testing to be capable of sustaining a 20,000 pound load based on the compressive tests results of the individual leg members 40. Cycle testing showed that the average life of a pallet deck 11 is at least 40 years. The deck 11 will outlast eighteen leg replacements, a single leg 40 failure occurring approximately every 3 to 4 years. Deflection testing where the deck member 11 was supported on opposing edges by racks contacting 2.5 inches of the lower sheet member 13 on each edge show deflection of only approximately ⅜ inch or less under a load of 4800 pounds. Vibration testing shows that the pallets have excellent vibration damping characteristics, especially low frequency vibrations, a factor believed to result from the extreme rigidity of the deck member 11.

It is understood that equivalents and substitutions for certain elements set forth above may be obvious to those skilled in the art, and the true definition and scope of the invention therefor is to be as set forth in the following claims.

I claim:

1. A single deck, nestable pallet comprising a generally planar deck member comprised of two sheet members, an upper sheet member and a lower sheet member both having an interior side and an exterior side, perimeter frame members located between and connected to said interior sides of said sheet members such that said sheet members are positioned generally parallel to each other and defining an interior space, said sheet members having a plurality of apertures, a ring support member positioned within each of said apertures, each said ring support member being connected to said upper sheet member and said lower sheet member such that the distance between each said sheet member is fixed, and leg members connected to said ring support members and extending from said lower sheet member, said leg members being hollow and tapered.

2. The pallet of claim 1, where said interior space is filled with a vibration damping material.

3. The pallet of claim 2, where said vibration damping material is a material chosen from the group consisting of corrugated paperboard, polystyrene foam blocks, polymer foam particles, and cured expandable polymer foam.

4. The pallet of claim 3, where said perimeter frame members are square-profile wooden members.

5. The pallet of claim 3, where at least one said perimeter frame members have a sloped outer wall and said upper sheet member is smaller than said lower sheet member.

6. The pallet of claim 5, where said sheet members are composed of a material chosen from the group of materials consisting of plywood, hardboard, oriented strand board and particle board.

7. The pallet of claim 1, where each said ring support member comprises an upper annular collar which mates with one of said apertures in said upper sheet member, an upper annular flange of greater radial dimension than said upper annular collar which abuts and supports said interior side of said upper sheet member, a lower annular flange which abuts said interior side of said lower sheet member, a lower annular collar of lesser radial dimension than said lower annular flange which mates with one of said apertures in said lower sheet member, connection means to join said ring member to one of said leg members, and an interior wall.

8. The pallet of claim 7, where each of said leg members comprises an annular insertion end member of lesser radial dimension than one of said apertures in said lower sheet member such that said insertion end member fits into one of said apertures of said lower sheet member, connection means to join said leg member to one of said ring members, an annular support flange of greater radial dimension than one of said apertures in said lower sheet member which abuts said exterior side of said lower sheet member, a tapered main body and a hollow interior.

9. The pallet of claim 8, where said connection means of said ring member comprises internal threading positioned on said interior wall and where said connection means of said leg member comprises external threading positioned on said insertion member, said internal threading and said external threading corresponding to join said leg member to said ring member.

10. The pallet of claim 9, where said apertures in said upper sheet member are larger than said apertures in said lower sheet member.

11. The pallet of claim 10, where said leg members and said ring members are made of plastic.

12. The pallet of claim 11, where said leg members are made of a softer plastic than said ring members.

13. The pallet of claim 8, where said interior space is filled with a vibration damping material.

14. The pallet of claim 13, where said vibration damping material is a material chosen from the group consisting of corrugated paperboard, polystyrene foam blocks, polymer foam particles, and cured expandable polymer foam.

15. The pallet of claim 14, where said perimeter frame members are square-profile wooden members.

16. The pallet of claim 14, where at least one said perimeter frame members have a sloped outer wall and said upper sheet member is smaller than said lower sheet member.

17. The pallet of claim 16, where said sheet members are composed of a material chosen from the group of materials consisting of plywood, hardboard, oriented strand board and particle board.

18. The pallet of claim 8, further comprising an annular cap member joined to each of said ring members, each said annular cap member having an annular wall, connection means to join said annular cap member to said ring member, and a radially extending flange member which abuts the exterior surface of said upper sheet member.

19. The pallet of claim 18, where said interior wall of said ring member is provided with upper connection means comprising upper internal threading on said interior wall to join said annular cap member to said ring member, and said connection means of said annular cap member comprises external threading corresponding to said upper internal threading.

* * * * *